US007347042B2

(12) United States Patent
Brück et al.

(10) Patent No.: US 7,347,042 B2
(45) Date of Patent: Mar. 25, 2008

(54) EXHAUST GAS FILTER AND METHOD FOR CLEANING AN EXHAUST GAS

(75) Inventors: Rolf Brück, Bergisch Gladbach (DE); Jan Hodgson, Troisdorf (DE)

(73) Assignee: Emitec Gesellschaft fuer Emissionstechnologie mbH, Lohmar (DE)

( * ) Notice: Subject to any disclaimer, the term of this patent is extended or adjusted under 35 U.S.C. 154(b) by 161 days.

(21) Appl. No.: 11/049,551

(22) Filed: Feb. 2, 2005

(65) Prior Publication Data

US 2005/0217258 A1 Oct. 6, 2005

Related U.S. Application Data

(63) Continuation of application No. PCT/EP03/07723, filed on Jul. 16, 2003.

(30) Foreign Application Priority Data

Aug. 2, 2002 (DE) ..... 102 35 766

(51) Int. Cl.
*F01N 3/00* (2006.01)
*F01N 3/02* (2006.01)
*B01D 50/00* (2006.01)

(52) U.S. Cl. ..... 60/297; 60/311; 422/180

(58) Field of Classification Search ..... 60/297, 60/299, 311; 422/180
See application file for complete search history.

(56) References Cited

U.S. PATENT DOCUMENTS 5,009,857 A 4/1991 Haerle
5,089,237 A * 2/1992 Schuster et al. ..... 422/180
5,171,341 A * 12/1992 Merry ..... 55/484
5,174,969 A * 12/1992 Fischer et al. ..... 422/180
5,709,722 A * 1/1998 Nagai et al. ..... 55/499
5,863,311 A * 1/1999 Nagai et al. ..... 55/483
5,908,480 A * 6/1999 Ban et al. ..... 55/482
5,961,931 A * 10/1999 Ban et al. ..... 422/171
6,669,913 B1 * 12/2003 Haberkamp ..... 422/180
6,776,814 B2 * 8/2004 Badeau et al. ..... 55/385.3
6,916,450 B2 * 7/2005 Akama et al. ..... 422/180
2002/0090324 A1 7/2002 Badeau et al.
2004/0013580 A1 1/2004 Bruck et al.
2004/0194440 A1 10/2004 Bruck et al.

FOREIGN PATENT DOCUMENTS

CN 1173582 A 2/1998
DE 38 18 281 A1 9/1989

(Continued)

*Primary Examiner*—Thomas Denion
*Assistant Examiner*—Loren Edwards
(74) *Attorney, Agent, or Firm*—Laurence A. Greenberg; Werner H. Stemer; Ralph E. Locher

(57) ABSTRACT

An exhaust gas filter for cleaning an exhaust gas of an internal combustion engine, includes at least one strip-shaped filter layer. The filter layer has at least one filter region formed of a material through which a fluid can at least partly flow, for filtering out particulates from the exhaust gas. The filter layer also has at least one contact region with a catalytically active coating, for conversion of gaseous components of the exhaust gas. A method for cleaning an exhaust gas of an internal combustion engine is also provided.

19 Claims, 2 Drawing Sheets

FOREIGN PATENT DOCUMENTS

| | | | |
|---|---|---|---|
| DE | 201 17 873 | U1 | 3/2002 |
| DE | 101 53 283 | A1 | 5/2003 |
| EP | 0 798 452 | A1 | 10/1997 |
| EP | 0 957 241 | A2 | 11/1999 |
| EP | 1 065 352 | A2 | 1/2001 |
| EP | 1 132 587 | A2 | 9/2001 |
| EP | 1 209 330 | A1 | 5/2002 |
| EP | 1 251 249 | A2 | 10/2002 |
| JP | 2002/113798 | | 4/2002 |

* cited by examiner

EXHAUST GAS FILTER AND METHOD FOR CLEANING AN EXHAUST GAS

CROSS-REFERENCE TO RELATED APPLICATION

This is a continuing application, under 35 U.S.C. § 120, of copending International Application No. PCT/EP2003/007723, filed Jul. 16, 2003, which designated the United States; this application also claims the priority, under 35 U.S.C. § 119, of German Patent Application 102 35 766.8, filed Aug. 2, 2002; the prior applications are herewith incorporated by reference in their entirety.

BACKGROUND OF THE INVENTION

Field of the Invention

The invention relates to an exhaust gas filter for cleaning an exhaust gas of an internal combustion engine, including at least one strip-shaped filter layer. The invention also relates to a method for cleaning an exhaust gas of an internal combustion engine.

Motor vehicles with diesel engines are being sold in increasing numbers in many countries, partly because of their relatively low fuel consumption. In comparison with gasoline-powered motor vehicles, diesel vehicles have a significantly reduced carbon dioxide emission, but the proportion of particulates produced during combustion in a diesel engine is much greater than that of a gasoline engine. In many countries motor vehicles have to comply with emission standards setting maximum limits for the concentration of individual components in the exhaust gas of the motor vehicle that is emitted into the environment.

If the cleaning of exhaust gases, in particular of diesel engines, is considered, hydrocarbons (HC) and carbon monoxide (CO) in the exhaust gas can be oxidized in a known way, by bringing them into contact, for example, with a catalytically active surface. However, the reduction of nitrogen oxides ($NO_x$) under oxygen-rich conditions is more difficult. A three-way catalytic converter, as is used for example in the case of spark-ignition engines, does not provide the desired effectiveness. For that reason, the method of selective catalytic reduction (SCR) has been developed. Furthermore, $NO_x$ adsorbers have been used on a trial basis for reducing the nitrogen oxides in exhaust gas.

Particulate traps which are constructed from a ceramic substrate are also known for the reduction of particulate emissions in the exhaust gas of diesel engines, in particular. Those traps have passages, so that the exhaust gas which is to be cleaned can flow into the particulate trap. The adjacent passages are alternately closed off, so that the exhaust gas enters the passage on the inlet side, passes through the ceramic wall and escapes again through the adjacent passage on the outlet side. Particulate traps of that type are known as closed particulate filters. They achieve an effectiveness of about 95% across the entire range of the particulate sizes occurring.

The reliable regeneration of the filter in the exhaust system of an automobile causes problems. It is necessary to regenerate the particulate trap since the increasing accumulation of particulates in the passage wall through which the exhaust gas is to flow causes a steadily increasing loss of pressure, which has adverse effects on the power of the engine. The regeneration substantially includes brief heating of the particulate trap, or of the particulates which have collected therein, so that the particulates are converted into gaseous constituents. However, that high thermal loading of the particulate trap has adverse effects on its service life.

In order to avoid such discontinuous regeneration, which in thermal terms leads to a high likelihood of wear, a system for the continuous regeneration of filters has been developed which uses a Continuous Regeneration Trap (CRT). In such a system, the particulates are converted through the use of oxidation with $NO_2$ at temperatures just above 200° C. That temperature limit is much lower than in the case of classical particulate traps. The $NO_2$ required for that purpose is often generated by an oxidation catalytic converter which is disposed upstream of the particulate trap. However, specifically with a view to use in motor vehicles which use diesel fuel, there is the problem in that case that the exhaust gas only contains an insufficient level of nitrogen monoxide (NO) which can be converted into the desired nitrogen dioxide ($NO_2$). Consequently, it has not been possible so far to ensure that the particulate trap is continuously regenerated in the exhaust system.

In addition to a minimum reaction temperature and a specific residence time, it is also necessary for sufficient nitrogen oxide to be provided for the continuous regeneration of particulates with $NO_2$. Tests relating to the dynamic emission of NO and particulates have clearly demonstrated that the particulates are emitted specifically when there is no NO or only a very small amount of NO in the exhaust gas, and vice versa. That means that a filter with real continuous regeneration must substantially act as a compensator or storage device, to ensure that the two reaction partners are simultaneously present in the required quantities in the filter at a given time, at which one of the conditions that are satisfied is the minimum reaction temperature. Furthermore, the filter is to be disposed as close as possible to the internal combustion engine, in order to allow it to reach temperatures which are as high as possible immediately after a cold start. In order to provide the required NO, an oxidation catalytic converter, which converts carbon monoxide and hydrocarbons and in particular also nitrogen monoxide into nitrogen monoxide, is to be connected upstream of the filter.

The filter material required therefor, which is capable of withstanding high thermal loading, is known from German Published, Non-Prosecuted Patent Application DE 101 53 283 A1, corresponding to U.S. Patent Application Publication No. U.S. 2004/0194440. Those documents describe a filter system which can basically be referred to as an "open filter system". An open system of that type dispenses with an inbuilt alternating closure of the filter passages. The passage walls are formed at least partly of porous or highly porous material. The flow passages of the open filter have diverting or guiding structures, which direct the exhaust gas with the particulates contained therein toward the regions made of porous or highly porous material. A particulate filter is referred to as open whenever it can in principle be passed through completely by particles, to be precise even by particles which are considerably larger than the particulates that are actually to be filtered out. As a result, such a filter cannot become clogged during operation, even if there is an agglomeration of particulates. A suitable method for measuring the openness of a particulate filter is for example that of testing up to which diameter spherical particles can still trickle through such a filter. In the case of the present applications, a filter is open in particular when spheres of a diameter greater than or equal to 0.1 mm can still trickle through, preferably spheres with a diameter above 0.2 mm.

However, the open particulate filter described in those documents has the problem that, due to the absolutely necessary oxidation catalytic converter which has to be disposed upstream of the particulate trap in the direction of flow, the cold-starting behavior of the particulate trap is relatively sluggish. In other words, the particulate trap is only heated up relatively slowly by the oxidation catalytic converter, which has to be heated up first.

SUMMARY OF THE INVENTION

It is accordingly an object of the invention to provide an exhaust gas filter for cleaning an exhaust gas of an internal combustion engine and a method for cleaning an exhaust gas of an internal combustion engine, which overcome the hereinafore-mentioned disadvantages of the heretofore-known devices and methods of this general type and which provide a rapid cold-starting behavior and satisfy the condition of continuous regeneration.

With the foregoing and other objects in view there is provided, in accordance with the invention, an exhaust gas filter for cleaning an exhaust gas of an internal combustion engine. The exhaust gas filter comprises at least one strip-shaped filter layer. The at least one filter layer has at least one filter region formed of a material through which a fluid can at least partly flow, for filtering out particulates from the exhaust gas. The at least one filter layer also has at least one contact region with a catalytically active coating, for conversion of gaseous components of the exhaust gas. If appropriate, a metal foil is additionally provided.

In other words, the contact region of the filter layer allows an oxidative conversion of the gaseous constituents of the exhaust gas to occur, with especially carbon monoxide and hydrocarbons, and in particular also nitrogen monoxide, being converted into nitrogen dioxide. Consequently, the contact region ensures that, once the operating temperature has been reached, there is sufficient $NO_2$ in the exhaust gas flowing through the filter region to ensure that the exhaust gas filter can be operated in a continuous regeneration mode with respect to the particulates filtered out, so that it is possible to dispense with the provision of an upstream oxidation catalytic converter to provide the necessary $NO_2$. Consequently, installation of the exhaust gas filter close to the engine is possible. This brings about more rapid heating-up of the actual exhaust gas filter, and consequently much improved cold-starting behavior, in comparison with the open filter system known from the prior art with an upstream oxidation catalytic converter.

It is particularly advantageous in this connection that the contact region can be formed in regions in which the filter layer is connected to possibly adjacent sheet-metal layers or else to a casing or jacket tube enclosing the exhaust gas filter. The formation of such a connection by a joining technique often takes place by brazing, but welding or other joining methods such as sintering are also possible. If the filter layer is made of a material through which a fluid can at least partly flow, the formation of this connection to other sheet-metal layers and/or the casing or jacket tube generally has the effect that in this region the filter layer can no longer be flowed through by a fluid, or only to a very small extent, since, for example in the case of brazing, the material is saturated with brazing material, so that absorption of particulates is no longer possible there. Consequently, these regions only contribute to the effectiveness of the exhaust gas filter to a reduced extent. For this reason it is advantageous to form the contact regions in these regions, since as a result, with the same construction, the filtering effectiveness of the filtration of particulates from the exhaust gas is not significantly reduced, but the installation of a separate oxidation catalytic converter can be avoided.

In accordance with another feature of the invention, the contact region at least partly includes a metal foil. The formation of the contact region at least partly from a metal foil allows simple coating of the contact region in an advantageous way, since a metal foil can be coated with catalytically active material in a known way, for example in the form of a so-called washcoat into which the catalytically active substances, for example noble metals such as platinum or rhodium, can be introduced. According to the invention, it is also possible to use already coated films for the formation of the contact region.

In accordance with a further feature of the invention, the metal foil is microstructured. With appropriate configuration of the structures, a microstructured metal foil has the effect of causing the flow in the flow passage to become more turbulent and no marginal layers of laminar flow form. This has the effect of diverting a greater proportion of the gas stream in the direction of the material regions through which a fluid can at least partly flow. As a result, the effectiveness of the filter is improved overall in an advantageous way. Furthermore, depending on the ratio of the thickness of the metal foil to the thickness of the material through which a fluid can at least partly flow, a microstructuring of the metal foil can be used to even out the thicknesses between the contact region and the filter region. Moreover, the micro-corrugation or micro-undulation of the metal foil provides a significantly increased reaction area for the conversion of the at least one gaseous constituent of the exhaust gas.

In accordance with an added feature of the invention, the contact region is formed at least partly of the material through which a fluid can flow. This advantageously allows the simple production of the exhaust gas filter, since for example the entire filter layer is formed only of the material through which a fluid can flow and this is coated or impregnated with the catalytically active material only in the contact region.

In accordance with an additional feature of the invention, the exhaust gas filter has a main direction of flow in which the exhaust gas passes therethrough. The contact region is formed upstream of the filter region in the main direction of flow. This advantageously allows the contact region to be formed specifically also in the edge region on the gas inlet side, which is frequently used for forming a connection between the various filter layers and/or metal layers and/or to the casing or jacket body. Consequently, there is in any case only a reduced filtering effectiveness in this region since, depending on the type of joining connection that is formed, the material through which a fluid can flow is saturated with brazing material and/or welding additive for example, and/or a compression of this region occurs. Moreover, such a refinement of the exhaust gas filter according to the invention has the advantage of making a sufficiently large amount of nitrogen dioxide available very quickly for the region contributing to the effectiveness of the particulate filtering process, that is for the downstream filter region, so that the filter region can also be operated in a CRT mode very quickly even after a cold start.

In accordance with yet another feature of the invention, the contact region is formed in the end region on the gas inlet side of the exhaust gas filter, preferably in a linear region of less than 20% of the axial length of the exhaust gas filter, particularly preferably in a linear region of less than 10% of the axial length of the exhaust gas filter. This makes it possible in an advantageous way to provide a sufficiently large amount of nitrogen dioxide for the CRT operation of the filter region with only a small effect on the filtering effectiveness of the filter region. Moreover, the formation of the contact region on the gas inlet side leads to protection against blowing out, by which the edge regions of the filter and/or sheet-metal layers on the gas inlet side that are subjected to considerable loading from pulses of exhaust gas are protected against fraying, so that the service life of the exhaust gas filter is increased.

In accordance with yet a further feature of the invention, the exhaust gas filter is formed by intertwined layers, which are at least partly filter layers. Other layers may for example be sheet-metal layers, which may be structured or of a substantially smooth configuration. It is particularly advantageous in this connection that the exhaust gas filter is formed by substantially smooth sheet-metal layers and structured filter layers or else by substantially smooth filter layers and structured sheet-metal layers. Such a construction allows the exhaust gas filter to be constructed for example as a honeycomb body from smooth and structured layers. The decision as to whether structured filter layers and smooth sheet-metal layers or structured sheet-metal layers and smooth filter layers are to be chosen is dependent on the requirements that the exhaust gas filter has to meet.

In accordance with yet an added feature of the invention, the metal foil and the material through which a fluid can at least partly flow are connected to each other by a joining technique. It is particularly preferable in this connection that the metal foil and the material through which a fluid can at least partly flow are welded, brazed and/or riveted, preferably welded and/or brazed, particularly preferably brazed. This advantageously allows a stable connection between the metal foil and the material through which a fluid can at least partly flow to be produced, which has positive effects on the durability of the filter layer. It is particularly advantageous in this connection if the metal foil is formed as a contact region upstream of the filter region in the region of the exhaust gas filter on the gas inlet side. The metal foil then also serves at the same time as a protection against blowing out in this partial region of the exhaust gas filter which is subjected to considerable loading from pulses of exhaust gas of the internal combustion engine and alternating thermal stresses. The effect of these pulses of exhaust gas is further intensified if it is installed particularly close to the engine.

In accordance with yet an additional feature of the invention, the material through which a fluid can at least partly flow is made up of metal fibers. This is advantageous since such a material through which a fluid can flow is very resistant to heat and consequently can be exposed to the alternating thermal loads in the exhaust system of a motor vehicle over a relatively long service life. It is particularly advantageous if the material through which a fluid can flow is made up of metal fibers in a sintered form.

With the objects of the invention in view, there is also provided a method for cleaning an exhaust gas of an internal combustion engine. The method comprises converting gaseous constituents of the exhaust gas and filtering-out particulates from the exhaust gas, in a honeycomb body, such as an exhaust gas filter according to the invention.

In accordance with another mode of the invention, the conversion of the gaseous constituents of the exhaust gas takes place upstream of the filtering-out of particulates relative to a main direction of flow through the exhaust gas filter. This advantageously allows the provision of nitrogen dioxide, which is required for the CRT operation of the filter region of the exhaust gas filter. It is consequently possible in an advantageous way to dispense with a separate oxidation catalytic converter upstream of the exhaust gas filter. This allows installation of the exhaust gas filter closer to the engine, providing it with improved cold-starting behavior in comparison with the open filter systems known from the prior art.

In accordance with a concomitant mode of the invention, the conversion of the gaseous particulates is catalyzed by at least one catalyst, preferably a noble metal catalyst. This advantageously allows the operating temperatures of the exhaust gas filter to be lowered.

Other features which are considered as characteristic for the invention are set forth in the appended claims.

Although the invention is illustrated and described herein as embodied in an exhaust gas filter and a method for cleaning an exhaust gas, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
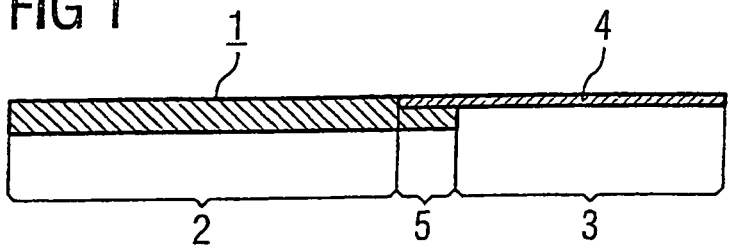
FIG. 1 is a diagrammatic, longitudinal-sectional view of a first exemplary embodiment of a filter layer of an exhaust gas filter according to the invention.

Referring now to the figures of the drawings in detail and first, particularly, to FIG. 1 thereof, there is seen a first exemplary embodiment of a filter layer 1, which serves for the construction of an exhaust gas filter according to the invention. The filter layer 1 has a filter region 2 and a contact region 3. The filter region 2 is formed from material through which a fluid can at least partly flow. The filter region 2 therefore is formed of a porous or highly porous material. The filter region 2 is preferably formed from metal fibers, particularly preferably from sintered metal fibers. The filter region 2 has a high thermal stability. In this exemplary embodiment of a filter layer 1, the contact region 3 is formed as a metal foil 4. The contact region 3 is coated with a catalytically active material. It is particularly preferred in this case for the coating to be in the form of a washcoat into which noble metal catalysts are introduced. The at least partial conversion of at least one gaseous constituent of an exhaust gas which is to be cleaned in the exhaust gas filter occurs in the contact region 3. The reactions of the gaseous constituent or constituents that are catalyzed by the catalytically active coating include, in any event, the conversion from NO to $NO_2$, and it is furthermore possible according to the invention to also convert hydrocarbons that reach the exhaust gas filter unburned, as well as carbon monoxide.

A fluid can flow through at least part of the filter region 2. The particulates contained in the exhaust gas are filtered out in this filter region 2. The particulates occur to an especially great extent in the exhaust gas of diesel engines. When an exhaust gas filter is made up at least partly by filter layers 1, interception and/or impaction of the particulates on and/or in the porous filter region 2 causes adhesion of at least some of the particulates that are in the exhaust gas. The pressure differences in the flow profile of the flowing exhaust gas are of significance for this effect to materialize. This effect can be further enhanced by microstructuring in the metal foil 4 and in adjacent sheet-metal layers which are not shown in FIG. 1, since local subatmospheric or superatmospheric pressure conditions additionally occur. These conditions increase the filtration effect through the porous wall.

The metal foil 4 and the filter region 2 overlap in a connecting region 5. In this region, a connection by a joining technique is provided between the metal foil 4, that is the contact region 3, and the filter region 2. This connecting region 5 may be produced, for example, by riveting, brazing or welding or by a combination of at least two of these methods. In the case of brazing, various brazing methods in which the brazing material is applied as powder or a brazing foil are possible. Furthermore, it is possible according to the invention for the metal foil 4 to have microstructures, preferably micro-undulations. These may serve on one hand for preventing laminar flows in the edge region. On the other hand, however, it is also possible in this way to compensate in an advantageous way for a difference in height between the filter region 2 and the contact region 3 and to therefore simplify the construction of the exhaust gas filter. This region may be formed of particularly thin foil, for example with a thickness of 15 to 30 μm, and/or have holes, in order to keep the thermal capacity low, which improves the cold-starting behavior.

It is also advantageously possible to furthermore compact the connecting region 5. This can take place by pressing, rolling or else as part of a welding method, such as for example the roller seam welding method.

Figure 2:
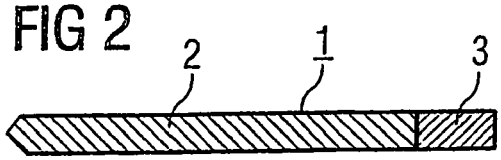
FIG. 2 is a longitudinal-sectional view of a second exemplary embodiment of a filter layer of an exhaust gas filter according to the invention.

FIG. 2 shows a further exemplary embodiment of a filter layer 1 for the construction of an exhaust gas filter according to the invention. This filter layer 1 also has a filter region 2 and a contact region 3. However, the embodiment of FIG. 2 differs from the exemplary embodiment shown in FIG. 1 in that the contact region 3 is also formed from porous material, which has been coated or impregnated with a catalytically active material. The impregnation of the contact region 3 with a washcoat which contains the noble metal catalysts is particularly advantageous in this connection. It is advantageously possible to pre-treat the contact region 3, in order to reduce the amount of coating or washcoat required. In this case, it is advantageously possible to perform a pre-impregnation with brazing material, which is absorbed by the porous or highly porous material of the contact region 3. Furthermore, the contact region 2 may also be pre-treated by a compression, for example by pressing or rolling, in order to reduce the amount of the washcoat that is absorbed.

The exemplary embodiments of a filter layer 1 shown in FIGS. 1 and 2 are illustrated in a smooth form, by way of example. However, the filter layer 1 may also be structured, preferably corrugated or undulated. It is possible according to the invention to combine smooth filter layers 1 with non-illustrated corrugated or undulated layers to form an exhaust gas filter. This may take place, for example, by constructing a honeycomb body that is known per se, for example in a spiral, S, SM or some other form. However, it is also possible for an exhaust gas filter, for example in the form of a honeycomb body, to be constructed by combining a structured filter layer 1 with smooth further layers.

Figure 3:
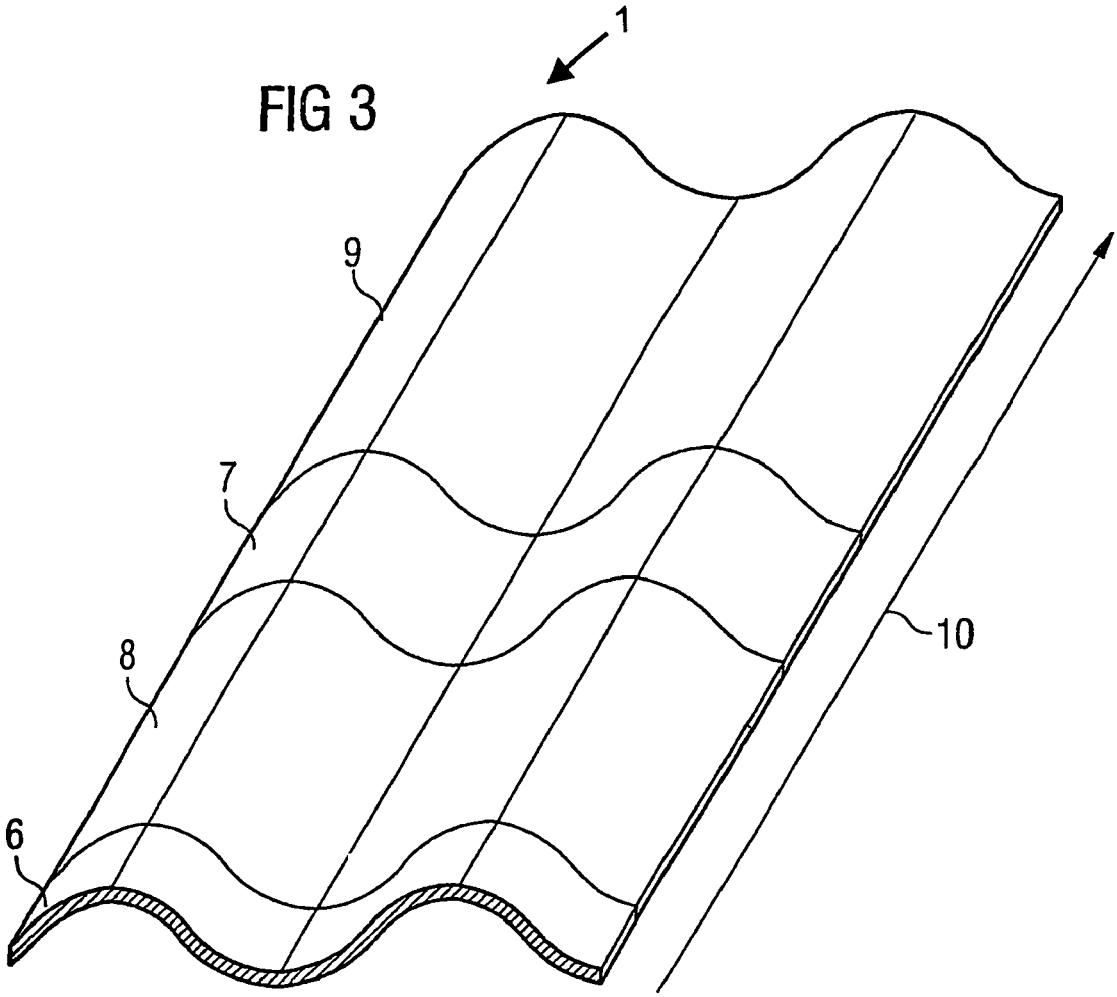
FIG. 3 is a perspective view of an exemplary embodiment of a filter layer of an exhaust gas filter according to the invention.

FIG. 3 shows an exemplary embodiment of a structured, that is corrugated or undulated, filter layer 1. This filter layer 1 has a first contact region 6, a second contact region 7, a first filter region 8 and a second filter region 9. The conversion of at least some of the gaseous constituents of the exhaust gas takes place in the two contact regions 6, 7. The conversion of NO to $NO_2$ preferably takes place in these regions. It is possible to operate the exhaust gas filter according to the invention in the CRT mode with the $NO_2$ produced as a result. The construction of a number of contact regions 6, 7 has the effect on average of a more even distribution of the $NO_2$ content in the axial direction 10, since not only does an absolute maximum of the $NO_2$ content occur in this case at the end of the first contact region 6, but two local maxima respectively occur at the end of the first contact region 6 and at the end of the second contact region 7. The formation of further contact and filter regions is also possible according to the invention.

Figure 4:
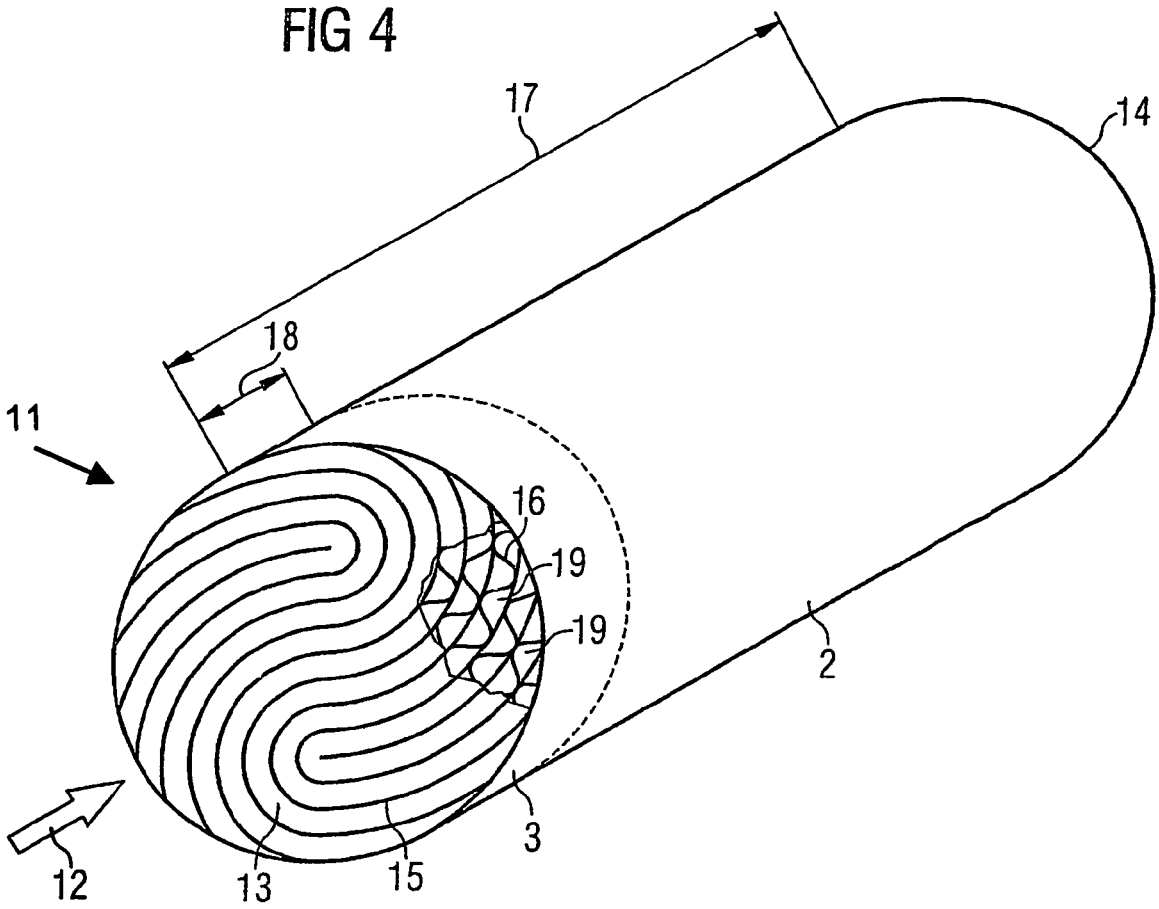
FIG. 4 is a perspective view of an exhaust gas filter according to the invention.

FIG. 4 shows an exhaust gas filter 11 according to the invention. An exhaust gas stream 12 flows through this filter 11 in the axial direction. The exhaust gas stream 12 flows into the exhaust gas filter 11 through a gas inlet side 13 and leaves the exhaust gas filter 11 through a gas outlet side 14. The exhaust gas filter 11 is constructed as a honeycomb body. As is shown in a small broken-away region, the exhaust gas filter 11 is made up of smooth layers 15 and structured layers 16, which alternate with one another and are intertwined in an S-shaped manner. According to the invention, it would be equally well possible for smooth layers 15 and structured layers 16 to be combined in some other way, for example to wind them in a spiral or SM form, or in any other forms. The smooth layers 15 and the structured layers 16 form passages 19 through which a fluid can flow, for example the exhaust gas stream 12.

It is possible according to the invention to use filter layers 1 as smooth layers 15 and sheet-metal layers as structured layers 16, but it is also equally well possible to use filter layers 1 as structured layers 16 and sheet-metal layers as smooth layers 15. The at least partial use of filter layers 1 both as smooth layers 15 and as structured layers 16 is also possible according to the invention.

The gas inlet side 13 of the exhaust gas filter 11 has a contact region 3, in which the conversion of at least part of at least one gaseous component of the exhaust gas stream 12 takes place. The conversion of nitrogen oxide into nitrogen dioxide, that is of NO to $NO_2$, preferably takes place in the contact region 3, so that the proportion of $NO_2$ that is necessary for CRT operation is produced by the conversions in the contact region. The joining of the smooth layers 15 to the corrugated or undulated layers 16 and/or to a non-illustrated casing or jacket tube which surrounds the honeycomb body, also preferably takes place at least in the contact region 3. The formation of the contact region in the form of metal foils which are connected to a filter region 2 also provides protection against blowing out on the gas inlet side 13. That is because, without protection against blowing out, the gas inlet side in particular is subjected to increased aging, since particularly great loading is exerted on the layers 15, 16 by the exhaust gases of the exhaust gas stream 12 impinging in the form of pulses.

A linear extent 18 of the contact region 3 is chosen to be much less than an axial length 17 of the exhaust gas filter 11. The linear extent 18 of the contact region 3 is preferably less than 20%, particularly preferably less than 10%, of the axial length 17 of the exhaust gas filter 11. Consequently, it is possible in an advantageous way to provide sufficient $NO_2$ for operation in the CRT mode by forming the contact region 3 in the vicinity of the gas inlet side 13 for the filter region 2. Consequently, without providing an additional oxidation catalytic converter upstream of the exhaust gas filter 11, it is possible to install the exhaust gas filter 11 close to the engine, which brings about very good cold-starting behavior of the exhaust gas filter 11. Furthermore, production costs can be saved in this way, since a separate oxidation catalytic converter does not have to be provided upstream of the exhaust gas filter 11.

We claim:

1. An exhaust gas filter for cleaning an exhaust gas of an internal combustion engine, the exhaust gas filter comprising:

a gas inlet side;

a gas outlet side, the exhaust gas flowing in a flow direction from said inlet to said outlet;

at least one strip-shaped filter layer extending from said gas inlet side to said gas outlet side in an axial direction;

said at least one filter layer having a filter region formed of a material through which a fluid can at least partly flow for filtering out particulates from the exhaust gas;

said at least one filter layer having a contact region with a catalytically active coating, for conversion of gaseous components of the exhaust gas;

said contact region having a metal foil with said catalytically active coating thereon, said metal foil disposed upstream of said filter region, in said axial direction; and said contact region and said filter region overlapping one another in a connecting region, said connecting region being smaller than said contact region in said axial direction.

2. The exhaust gas filter according to claim 1, wherein said at least one contact region is at least partly formed of a metal foil.

3. The exhaust gas filter according to claim 2, wherein said metal foil is microstructured.

4. The exhaust gas filter according to claim 2, wherein said metal foil and said material through which a fluid can at least partly flow are connected to each other by a joining technique.

5. The exhaust gas filter according to claim 4, wherein said joining technique connecting said metal foil and said material through which a fluid can at least partly flow, is at least one technique selected from the group consisting of welding, brazing and riveting.

6. The exhaust gas filter according to claim 1, wherein said at least one contact region is formed at least partly of said material through which a fluid can flow.

7. The exhaust gas filter according to claim 1, wherein said at least one contact region is disposed upstream of said at least one filter region in said exhaust gas flow direction.

8. The exhaust gas filter according to claim 7, wherein said at least one contact region is disposed at said gas inlet side.

9. The exhaust gas filter according to claim 8, which further comprises an axial exhaust gas filter length, said at least one contact region being disposed in a linear region of less than 20% of said axial exhaust gas filter length.

10. The exhaust gas filter according to claim 8, which further comprises an axial exhaust gas filter length, said at least one contact region being disposed in a linear region of less than 10% of said axial exhaust gas filter length.

11. The exhaust gas filter according to claim 1, which further comprises intertwined layers being at least partly formed of said at least one filter layer.

12. The exhaust gas filter according to claim 11, wherein said intertwined layers are substantially smooth sheet-metal layers and structured filter layers.

13. The exhaust gas filter according to claim 11, wherein said intertwined layers are substantially smooth filter layers and structured sheet-metal layers.

14. The exhaust gas filter according to claim 1, wherein said material through which a fluid can at least partly flow is made up of metal fibers.

15. A method for cleaning an exhaust gas of an internal combustion engine, which comprises:

converting gaseous constituents of the exhaust gas and filtering-out particulates from the exhaust gas, in a honeycomb body of an exhaust gas filter according to claim 1.

16. The method according to claim 15, which further comprises carrying out the step of converting the gaseous constituents of the exhaust gas upstream of the step of filtering-out the particulates, relative to a main direction of flow through the honeycomb body.

17. The method according to claim 15, which further comprises catalyzing the conversion of the gaseous particulates with at least one catalyst.

18. The method according to claim 15, which further comprises catalyzing the conversion of the gaseous particulates with at least one noble metal catalyst.

19. A method for cleaning an exhaust gas of an internal combustion engine, which comprises:

converting gaseous constituents of the exhaust gas and filtering-out particulates from the exhaust gas, in an exhaust gas filter according to claim 1.

* * * * *